United States Patent [19]

Heck

[11] 4,147,335

[45] Apr. 3, 1979

[54] APPARATUS FOR HARDENING THE CAM TRACKS OF CAMSHAFTS FOR INTERNAL COMBUSTION ENGINES

[75] Inventor: Klaus Heck, Ingolstadt, Fed. Rep. of Germany

[73] Assignee: Audi-Nsu Auto Union Aktiengesellschaft Neckarsulm, Neckarsulm, Fed. Rep. of Germany

[21] Appl. No.: 873,428

[22] Filed: Jan. 27, 1978

[30] Foreign Application Priority Data

Jan. 28, 1977 [DE] Fed. Rep. of Germany ..... 2703469

[51] Int. Cl.[2] ..... C21D 1/08

[52] U.S. Cl. ..... 266/261

[58] Field of Search ..... 266/124, 125, 128, 249, 266/261; 148/141, 150–152, 146

[56] References Cited

U.S. PATENT DOCUMENTS

| | | | |
|---|---|---|---|
| 1,768,160 | 6/1930 | Shorter et al. | 266/125 |
| 2,085,790 | 7/1937 | Campbell | 266/261 |
| 2,215,576 | 9/1940 | Bucknam et al. | 266/261 |
| 2,242,158 | 5/1941 | Wasson et al. | 148/151 |
| 2,290,283 | 7/1942 | Jones | 266/125 |
| 2,665,126 | 1/1954 | Roehm | 148/151 |

*Primary Examiner*—Gerald A. Dost

*Attorney, Agent, or Firm*—Cushman, Darby & Cushman

[57] ABSTRACT

An apparatus for hardening the cam tracks of camshafts in which one or more camshafts to be hardened are mounted adjacent a master camshaft for synchronous rotation therewith. A plurality of burners are slidably mounted adjacent each track to be hardened for movement toward and away from the track. A follower on the corresponding track of the master camshaft controls movement of the burner. An eccentric oscillates a plate on which the camshafts are mounted to cover all of the cam track. The burner is turned on and off so that the zone of the cam base circle is not heated and remains unhardened.

10 Claims, 5 Drawing Figures

APPARATUS FOR HARDENING THE CAM TRACKS OF CAMSHAFTS FOR INTERNAL COMBUSTION ENGINES

The invention relates to an apparatus for hardening the cam tracks of camshafts for internal combustion engines along the principles of the arc remelting hardening process.

It is an object of the invention to provide a reliable and economical apparatus for hardening the cam tracks of camshafts.

Each camshaft to be hardened is mounted adjacent a master camshaft for synchronous rotation therewith. Burners are slidably mounted adjacent each cam track to be hardened and are movable toward and away from the cam track under control of followers on the corresponding tracks of the master camshaft. Each burner is turned on and off so that the zone of the cam base circle is not heated. An eccentric oscillates a plate on which the camshafts are mounted so as to cover all of the cam tracks.

Further significant features and advantages of the invention will become apparent in the dependent claims and during the course of the following description of two illustrative embodiments of the invention.

Figure 1:
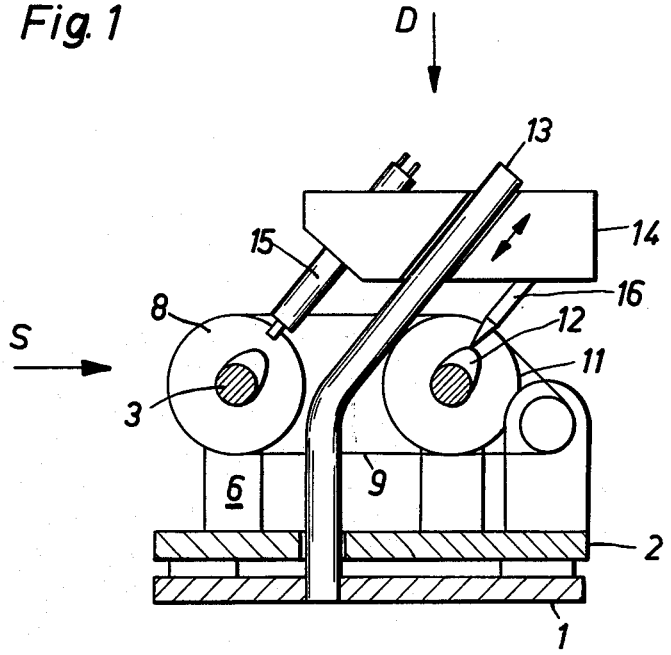
FIG. 1 is a section taken on the line I—I of FIG. 2 showing an apparatus according to principles of the invention for hardening the cam track of a camshaft.
Figure 2:
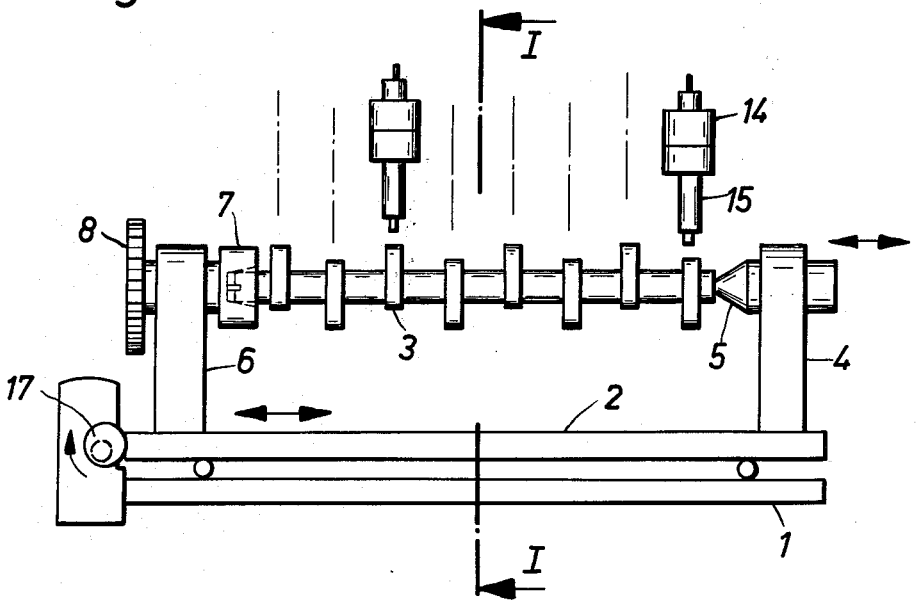
FIG. 2 is a detail S of the apparatus according to the invention shown in FIG. 1.
Figure 3:
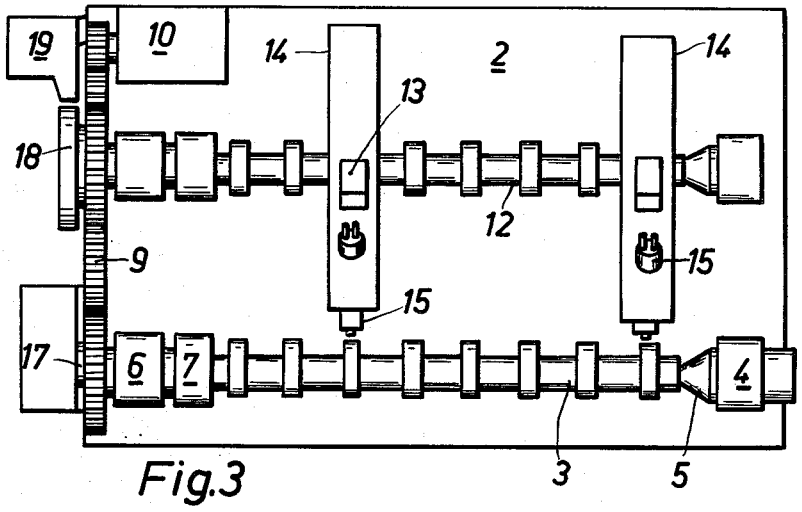
FIG. 3 is a detail D of the device according to the invention shown in FIG. 1.

The apparatus shown in FIGS. 1–3 has an engine base 1 on which a plate 2 is slidably mounted. On the plate is arranged a clamping device for a camshaft 3 to be hardened. This clamping device consists, on the one hand, of a tailstock 4 with a center 5 and, on the other hand, a pillow block 6 with a taper sleeve 7 pivotally mounted therein. The taper sleeve 7 rests on a common shaft having a driving gear 8 driven by an electric motor 10 via a toothed belt 9. This toothed belt 9 simultaneously drives another driving gear 11 coupled to a master camshaft which is fixed in rotational position parallel to the camshaft 3. In the taper sleeve 7 is a driver (not shown) which engages in an appropriate groove of the camshaft 3, thereby ensuring a continuously well-defined position of the camshaft 3 relative to the driver gear 8. The drive gears 8 and 11 have the same number of teeth and are adjusted to one another in such a manner that the cams of the camshaft 3 and of the master camshaft 12 rotate in synchronism with one another. In accordance with the number of cams to be hardened, there are connected with the engine base 1, in the upper zone, guides 13 extending at an angle of 30% and on which are mounted the slides 14. Secured to the slides 14 are the heater or burners 15 and the followers 16 sensing the master camshaft 12 and in this way causing the radial travel of the slides 14 and of heaters 15. For simplicity only two burners 15 or two slides 14 are shown in FIGURES 2 and 3, the others being suggested by center lines. An eccentric 17 is mounted at one front end of the engine base 1 driven by an electric motor (not shown) and running against the front end of the plate 2 in such a way that the latter oscillates with an amplitude equalling the width of the cam. Coaxially with the driving gear 11 on the master camshaft 12 is mounted a disk cam 18 (FIG. 3) running with the outer circumference past a switch 19 and turning the heater 15 on and off by use of impulses. The disk cam 18 initiates for each cam an impulse for turning on and off the appropropriate heater 15. Experiments have shown that a hardening of only the cam zone of each cam ensures an adequate wear resistance of the camshaft 3. Accordingly, the heaters 15 are turned off above the base circle of the cam (saving 50% of the otherwise expended energy).

The apparatus according to the invention in FIGS. 1–3 operates as follows.

The camshaft 3 to be hardened is inserted in the clamping device, the center 5 being pushed back against the tension of a spring (not shown). By rotating the camshaft 3, the latter engages the driver of the taper sleeve. The camshaft 3 and the master camshaft 12 are rotated by turning on the electric motor 10. With a first connecting impulse the co-rotating disc cam 18 ignites the heater 15 in which runs in the first cam zone. Further, turn-on and turn-off of the appropriate heater occurs in the sequence of the cam of the camshaft and ends with the disconnecting impulse for the cam which is the last in the sequence and with which the electric motor 10 is again switched off simultaneously. During the remelting or hardening of a cam zone, the radial travel of the burner 15 or of the appropriate slide 14 is caused by the sensing of the follower 16 of the synchronously co-rotating cam of the master camshaft 12 so that a continuous spacing of about 2 mm intermediate between the cam to be remelted and the tungsten electrode of the burner 15 is sustained. It goes without saying that a current connection must be established at the proper place on the camshaft 3 to close the circuit. When the electric motor 10 is turned on, the electric motor for driving the eccentric 17 is simultaneously put into operation so that the plate 2 oscillates in an amplitude equalling the width of the cam with respect to the engine base 1 or to the guides 13, the slides 14, the burner 15 and the follower 16. As a result, the hardened track on the particular cam runs in a wavy evenly alternating curved path. Experiments have shown that in this way an adequately wear-resistant hardening of the cam track is achieved without great expense. The frequency of the plate 2 relative to the angular velocity of the camshaft 2 must be tuned in conformity with the physical dimensions and performance criteria of the camshaft 3.

Figure 4:
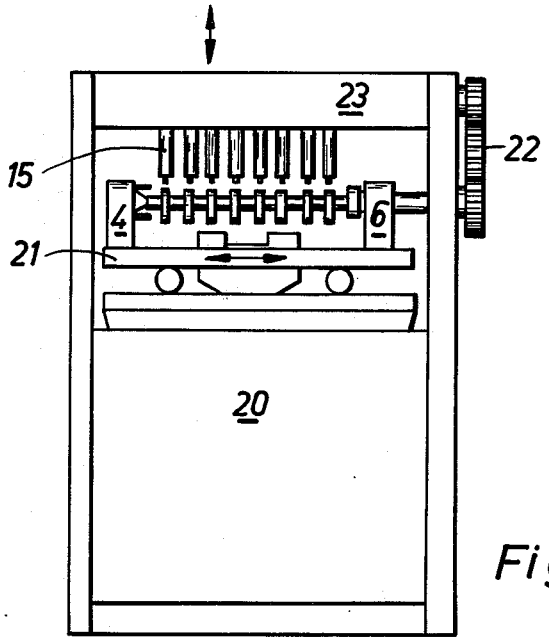
FIGS. 4 and 5 are two schematic illustrations of the apparatus according to the invention suitable for series production.
Figure 5:
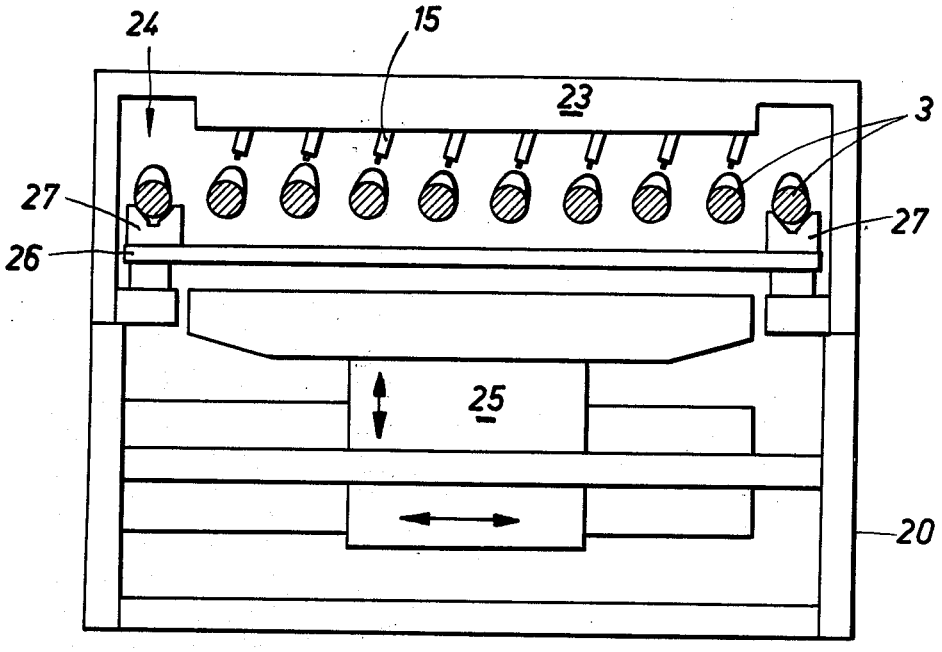

FIGS. 4 and 5 illustrate schematically an apparatus which is fully automated along essentially the same principles. Like signs denote like parts. A base plate 21 is slidably mounted on the engine base 20. On the base plate 21 are spaced at a short distance from one another as many clamping devices (tailstock 4 with dead center 5, pillow block 6 and taper sleeve 7) as there are cams of the camshaft 3 to be hardened (i.e., eight in the illustrative embodiment). The driving gears 8 of the eight taper sleeves 7 are synchronoulsy driven via a common toothed belt 22 by use of an electric motor (not shown), the drivers in the taper sleeves 7 being staggered in accordance with the offset angle of one cam relative to another cam so that, as shown in FIG. 5, for each camshaft 3 a different cam runs past the eight burners 15 secured to a common slide 23. Accordingly, the intersecting plane in the zone of the camshafts 3 in FIG. 5

(e.g., starting from the left of the drawing) must be considered offset by one cam at right angles to the drawing surface. The vertical travel of the slide 23 is controlled by a master camshaft (not shown) having one cam only. Also, the turn-on and turn-off of the eight burners 15 is simultaneous. The apparatus further has at 24 a preheating station in which the camshaft 3 is clamped in a manner not shown in detail and is preheated conductively up to about 680° K. The even preheating of the whole camshaft facilitates the subsequent remelting process, and thermal stresses or tension cracks are avoided. The camshafts are automatically conveyed by a (e.g., pneumatically actuated) conveyor 25, the rocker bars 26 of which arranged on either side of the camshafts are movable in horizontal and vertical direction. Each of the rocker bars 26 has ten prismatic carriers 27 (only two of which are shown in FIG. 5) to convey the camshafts.

The camshafts are conveyed by raising the rocker bars 26 and simultaneously moving backward the tailstocks 4, so that the camshafts dwell on the carriers 27. At the same time, also the clamping device in the preheating station is released, so that the preheated camshaft, too, dwells freely on the corresponding carriers 27. The rocker bars 26 are then moved horizontally a distance of one clamping device to another. Now, the tailstocks 4 or the clamping device of the preheating station return to their clamping positions. The electric motor driving the taper sleeves 7 is turned on and rotates the taper sleeves 7 until their carriers engage in the particular groove of the camshaft. The slide 23 which was raised during the conveyance of the camshafts is lowered and now rests on the master cams. In the meantime, the rocker bars 26 were also lowered and slided back horizontally to their starting points. After the lowering of the slide 23, burners 15 are ignited. At the same time, the base plate 21 starts oscillating. During the simultaneous remelting of any one cam of the eight cam shaft 1, the cam shaft is reheated in the preceeding preheating station 24. After turning off burner 15, the slide 23 is raised and the above-described process repeated.

While the apparatus shown in FIGS. 1–3 is designed for fairly small quantities, whereby in essentially the same arrangement fewer burners (e.g., only two) may be employed, the device shown in FIGS. 4 and 5 is provided for automatic operation or series production. One camshaft is completed with each clock pulse, the time required equalling the time needed for the remelting process of a single cam track plus the time of conveyance. The automatic control may be electronic.

Many changes and modifications to the above-described embodiment may be made without departing from the scope of the invention, and that scope is, of course, only limited by the scope of the appended claims.

What is claimed is:

1. An apparatus for hardening, without quenching, the cam tracks of a camshaft for internal combustion engines comprising:

a frame;

means mounted on said frame for mounting for rotation a camshaft to be hardened;

a master camshaft having at least one cam track of substantially the same shape and orientation as the cam track of said camshaft to be hardened;

means for mounting for rotation adjacent to said camshaft to be hardened said master camshaft;

means for synchronously rotating said camshaft to be hardened and said master camshaft;

at least one arc-remelting burner for heating a corresponding cam track of said camshaft to be hardened;

means, connected to said at least one burner and responsive to the rotational orientation of said master camshaft, for mounting said at least one burner for movement toward and away from said corresponding cam track such that at all times said at least one burner is maintained at a uniform distance from the surface of said corresponding cam track;

means for moving said camshaft rotational mounting means axially of said at least one camshaft to be hardened such that during rotation of said camshafts, said camshaft to be hardened oscillates axially with an amplitude substantially equal to the width of said corresponding cam tracks and with a frequency which may be tuned relatively to the angular rotational velocity of the camshafts in conformity with the physical dimensions and performance criteria of the camshaft to be hardened.

2. An apparatus as in claim 1, further including means for turning said burner on and off during said rotation so that the zone of the cam base circle is not heated.

3. An apparatus as in claim 1, wherein:

said camshaft to be hardened mounting means includes a rotating clamp, a base plate mounted on said clamp and slidably mounted for movement in the axial direction of said camshafts and said means for moving said camshaft rotational mounting means axially comprises an eccentric drive coupled to said rotating means.

4. An apparatus as in claim 1, including means for preheating said camshaft to be hardened.

5. An apparatus as in claim 1 including means for mounting a plurality of said camshafts to be hardened.

6. An apparatus as in claim 1, wherein said means for mounting said at least one burner comprises:

guideways mounted on said frame and oriented for sliding a slide toward and away from said corresponding cam track;

a slide mounted to said at least one burner and arranged to slide on said guideways; and cam follower means attached to said slide for following the cam profile of said master camshaft.

7. An apparatus as in claim 6 wherein:

said at least one burner comprises one corresponding burner for each cam track of said camshaft to be hardened; and said apparatus further comprises one said burner mounting means for each said burner.

8. An apparatus as in claim 1 further comprising:

means for mounting a plurality of approximately identical camshafts to be hardened in juxtaposed position, said plurality mounting means including:

clamp means including work drivers for rotatably clamping each of said plurality of camshafts to be hardened in juxtaposed position; and a single base plate mounted on said camshaft clamp means and slideably mounted on said frame for movement in the axial direction of said plurality of camshafts to be hardened, so that said plate, clamps and camshafts to be hardened, may be oscillated in unison; and a plurality of arc remelting burners corresponding to a different cam track of each camshaft to be hardened;

said work drivers being rotationally oriented one from another in accordance with the offset angle of one said cam track relative to another said cam track so that a different cam track of each camshaft to be hardened is maintained at a uniform distance from said corresponding burner;

each said corresponding burner being mounted on said slide and said plurality mounting means being synchronously driven.

9. An apparatus as in claim 2 further comprising:

means for mounting a plurality of approximately identical camshafts to be hardened in juxtaposed position, said plurality mounting means including:

clamp means including work drivers for rotatably clamping each of said plurality of camshafts to be hardened in juxtaposed position; and a single base plate mounted on said camshaft clamp means and slideably mounted on said frame for movement in the axial direction of said plurality of camshafts to be hardened, so that said plate, clamps and camshafts to be hardened, may be oscillated in unison; and a plurality of arc remelting burners corresponding to a different cam track of each camshaft to be hardened;

said work drivers being rotationally oriented one from another in accordance with the offset angle of one said cam track relative to another said cam track so that a different cam track of each camshaft to be hardened is maintained at a uniform distance from said corresponding burner;

each said corresponding burner being mounted on said slide and said plurality mounting means being synchronously driven.

10. An apparatus as in claim 6 further comprising:

means for mounting a plurality of approximately identical camshafts to be hardened in juxtaposed position, said plurality mounting means including:

clamp means including work drivers for rotatably clamping each of said plurality of camshafts to be hardened in juxtaposed position; and a single base plate mounted on said camshaft clamp means and slideably mounted on said frame for movement in the axial direction of said plurality of camshafts to be hardened, so that said plate, clamps and camshafts to be hardened, may be oscillated in unison; and a plurality of arc remelting burners corresponding to a different cam track of each camshaft to be hardened;

said work drivers being rotationally oriented one from another in accordance with the offset angle of one said cam track relative to another said cam track so that a different cam track of each camshaft to be hardened is maintained at a uniform distance from said corresponding burner;

each said corresponding burner being mounted on said slide and said plurality mounting means being synchronously driven.

* * * * *